US008734136B2

(12) United States Patent
Kränzle et al.

(10) Patent No.: US 8,734,136 B2
(45) Date of Patent: May 27, 2014

(54) WATER-CONDUCTING HOUSEHOLD APPLIANCE, PARTICULARLY A DISHWASHER

(75) Inventors: Bernd Kränzle, Dischingen (DE); Stephan Lutz, Zusamaltheim (DE); Michael Georg Rosenbauer, Reimlingen (DE); Markus Wecker, Gundremmingen (DE)

(73) Assignee: BSH Bosch und Siemens Hausergeraete GmbH, Munich (DE)

( * ) Notice: Subject to any disclaimer, the term of this patent is extended or adjusted under 35 U.S.C. 154(b) by 175 days.

(21) Appl. No.: 13/256,953

(22) PCT Filed: Mar. 16, 2010

(86) PCT No.: PCT/EP2010/053374

§ 371 (c)(1),
(2), (4) Date: Sep. 16, 2011

(87) PCT Pub. No.: WO2010/115685

PCT Pub. Date: Oct. 14, 2010

(65) Prior Publication Data

US 2012/0009074 A1 Jan. 12, 2012

(30) Foreign Application Priority Data

Apr. 6, 2009 (DE) ..... 10 2009 002 224

(51) Int. Cl.
*F04D 9/02* (2006.01)
*F04D 9/00* (2006.01)

(52) U.S. Cl.
CPC . *F04D 9/006* (2013.01); *F04D 9/02* (2013.01)
USPC ..... 417/430

(58) Field of Classification Search
CPC ..... F04D 9/004; F04D 9/007
USPC ..... 134/56 R, 57 R, 57 D, 56 D, 58 R, 58 D, 134/111; 417/423.9, 423.1, 430, 53
See application file for complete search history.

(56) References Cited

U.S. PATENT DOCUMENTS

| | | | | |
|---|---|---|---|---|
| 5,219,276 | A * | 6/1993 | Metzner et al. | 417/356 |
| 2006/0237035 | A1 * | 10/2006 | Ferguson et al. | 134/10 |
| 2010/0186787 | A1 | 7/2010 | Rosenbauer et al. | |

FOREIGN PATENT DOCUMENTS

| | | | |
|---|---|---|---|
| DE | 9406463 | U1 | 6/1994 |
| DE | 4341215 | A1 | 6/1995 |
| DE | 4437346 | A1 | 3/1996 |

OTHER PUBLICATIONS

International Search Report PCT/EP2010/053374, Jul. 2010.
Report of Examination DE 10 2009 002 224.4, Oct. 2010.

* cited by examiner

*Primary Examiner* — Bryan Lettman
(74) *Attorney, Agent, or Firm* — James E. Howard; Andre Pallapies

(57) ABSTRACT

A water-conducting household device, particularly a dishwasher, includes a pump having at least one normal operating mode in which fluid is pumped in a pumping direction, and a venting operating mode which can be carried out before the normal operating mode. The venting operating mode is provided to allow venting of the pump by pumping a gas bubble in opposition to the pumping direction during the normal operating mode at least partially out of a pump chamber of the pump to a fluid pump inlet of the pump.

58 Claims, 4 Drawing Sheets

WATER-CONDUCTING HOUSEHOLD APPLIANCE, PARTICULARLY A DISHWASHER

BACKGROUND OF THE INVENTION

The invention relates to a water-conducting household appliance, particularly a dishwasher.

In water-conducting household appliances, it is very important to achieve low-noise operating behavior as well as a maximum possible delivery rate. For example, a dishwasher comprises a discharge pump which is connected to a sump on the suction side. A pump chamber, in which a pump impeller runs, is connected in the upper region in terms of flow technology to the sump via a ventilation opening. In this manner, after the pump impeller stops, the gas collecting above a residual fluid column is able to escape into the sump via the ventilation opening. As a result, the pump impeller is submerged further into the residual fluid. When switched on again, therefore, the discharge pump achieves its maximum delivery rate in a short time with low-noise operating behavior. A drawback during the pump operation is that a proportion of the quantity of rinsing fluid already filtered in the sump is passed back into the sump again via the ventilation opening, whereby the delivery rate of the discharge pump is impaired.

BRIEF SUMMARY OF THE INVENTION

The object of the invention is to provide a water-conducting household appliance, particularly a dishwasher, comprising a pump which has an improved delivery rate.

The solution is based on a water-conducting household appliance, particularly a dishwasher, at least comprising a pump, by means of which fluid can be pumped in at least one normal operating mode.

According to the invention, the pump is able to be vented by a venting operating mode which can be carried out before the normal operating mode, during which a gas bubble can be pumped against the pumping direction in effect during the normal operating mode at least partially out of a pump chamber of the pump to a fluid pump inlet of the pump. As a result of the venting operating mode, a ventilation opening in the pump chamber which is conventional in the prior art may be dispensed with. Consequently, rinsing fluid which has already been filtered is not able to re-enter the sump. In comparison with the generic venting of pumps, the delivery rate of the pump is improved by the venting operating mode according to the invention. The pump may be operated discontinuously during the venting operating mode and temporarily have a lower delivery rate than during normal operation of the pump.

To this end, in a development of the invention, during the venting operating mode the gas bubble is at least partially displaced by the annular flow in the pump, which is produced by the pump. Thus the gas bubble may be displaced in the direction of the rotational axis of the pump impeller, from where it ultimately enters the fluid pump inlet.

In this case, it is provided in a development of the invention that the rotational direction of the pump is the same during the normal operating mode and the venting operating mode. Thus a drive which may be operated in two directions is not required for driving the pump and, therefore, a correspondingly configured control unit is also not required for controlling the drive of the pump.

Moreover, it is provided in a development of the invention that the pump may be operated during the venting operating mode with a different rotational speed characteristic than during the normal operating mode.

To this end, it is provided in a development of the invention that the rotational speed characteristic during the venting operating mode has a greater rotational speed fluctuation range than during the normal operating mode. In other words, the rotational speed of the pump fluctuates during the normal operating mode and during the venting operating mode between a lower and upper rotational speed which defines the rotational speed fluctuation range. This rotational speed fluctuation range is greater during the venting operating mode than during the normal operating mode.

Moreover, it is provided in a development of the invention that the rotational speed characteristic during the venting operating mode has larger and/or greater alterations to the rotational speed per unit of time than during the normal operating mode. In other words, the rotational speed changes during the venting operating mode to a greater extent than during normal operating mode, for example per second or minute as a unit of time.

To this end, it is provided in a development of the invention that the pump may be operated discontinuously during the venting operating mode. Accordingly, a continuous flow is not present. In contrast, in normal operating mode the pump is operated continuously so that a continuous flow is present during operation.

Moreover, it is provided in a development of the invention that the pump has a lower delivery rate during the venting operating mode than during the normal operating mode of the pump.

Moreover, it is provided in a development of the invention that the fluid pump inlet is connected to a sump of a pump configured as a discharge pump. In this case, the discharge pump is used to pump fluid, such as for example soiled washing fluid, from the water-conducting household appliance into a waste water disposal system on the house side.

It is provided in a development of the invention that a pump impeller of the pump carries out at least one intermittent rotational movement at least occasionally during the venting operating mode. According to a development of the invention, the venting operating mode is implemented by corresponding activation of the fluid pump by a control device. In the venting operating mode, the gas bubble remaining above a residual fluid column after the stoppage of the pump impeller may be displaced at least partially to a fluid pump inlet or outlet. This may take place by the pump impeller being activated for performing at least one intermittent rotational movement. As a result, the residual fluid column in the pump chamber is set in motion, whereby the gas bubble is displaced. By the intermittent rotational movement of the pump impeller, and by the brief formation of an annular flow, the residual fluid column is able to displace the gas bubble in the direction of a rotational axis of the pump impeller. The gas bubble may, therefore, at least partially escape via an inlet or outlet pipe of the fluid pump. The inlet or outlet pipe may preferably be oriented axially and/or oriented coaxially to the pump impeller rotational axis.

Tests have shown that when an annular flow with a turbulent flow pattern is temporarily generated, a relatively large quantity of gas is displaced from the pump chamber. With this in mind, the intermittent rotational movement of the pump impeller may include up to five revolutions. It is particularly preferable, however, if the pump impeller is moved by a rotational angle which is less than 360°, in particular less than 240° or 120°. With such small alterations to the rotational angle, on the one hand, the energy consumption is minimal. On the other hand, also the time required for carrying out the intermittent rotational movement is minimal, which occurs in the order of fractions of a second.

For activating the venting operation of the fluid pump, the control device is able to activate the fluid pump by a venting signal. The venting signal may preferably be immediately before the actual signal for the start of operation, so that after the venting has been carried out the actual start of operation of the fluid pump begins in which the power of the pump is continuously increased up to maximum delivery rate.

For driving the fluid pump, a DC motor may be used, in particular a brushless DC motor with electronic commutation, i.e. a BLDC motor. The DC motor may be designed to be multi-phase, namely two-phase or three-phase. In particular, when using a two-phase or three-phase DC motor, the intermittent rotational movement of the pump impeller may be particularly easily achieved with precisely predefinable rotational angles, by only one phase, or only two phases in the case of a three-phase DC motor, being switched.

So that the gas bubble remaining after the venting operation in the pump chamber is reduced as far as possible, a sequence of, in particular, up to three intermittent rotational movements of the pump impeller may be carried out. The rotational movements may be repeated with brief interruptions, the duration of an interruption being able to be in the order of approximately 0.3 s. The execution of the intermittent rotational movement of the pump impeller itself extends over a short time period, in the order of 0.1 s. In such an arrangement, therefore, the entire venting process is less than 1.5 s.

In a particular embodiment, the fluid pump may be used as a discharge pump in a dishwasher. The discharge pump is connected by its pump inlet to a sump of the dishwasher, in which the gas bubble may escape after the intermittent movement of the pump impeller has taken place. The pump inlet may preferably be arranged coaxially to the rotational axis of the pump impeller.

The intermittent rotational movement of the pump impeller may take place without creating fluid pressure, by which a non-return valve element on the pressure side is opened. In the case of the discharge pump of the dishwasher, the non-return valve element on the pressure side separates the hydraulic circuit of the dishwasher from the waste water system.

BRIEF DESCRIPTION OF THE DRAWINGS

An exemplary embodiment of the invention is described hereinafter with reference to the accompanying drawings, in which.

DETAILED DESCRIPTION OF EXEMPLARY EMBODIMENTS OF THE PRESENT INVENTION

Figure 1:
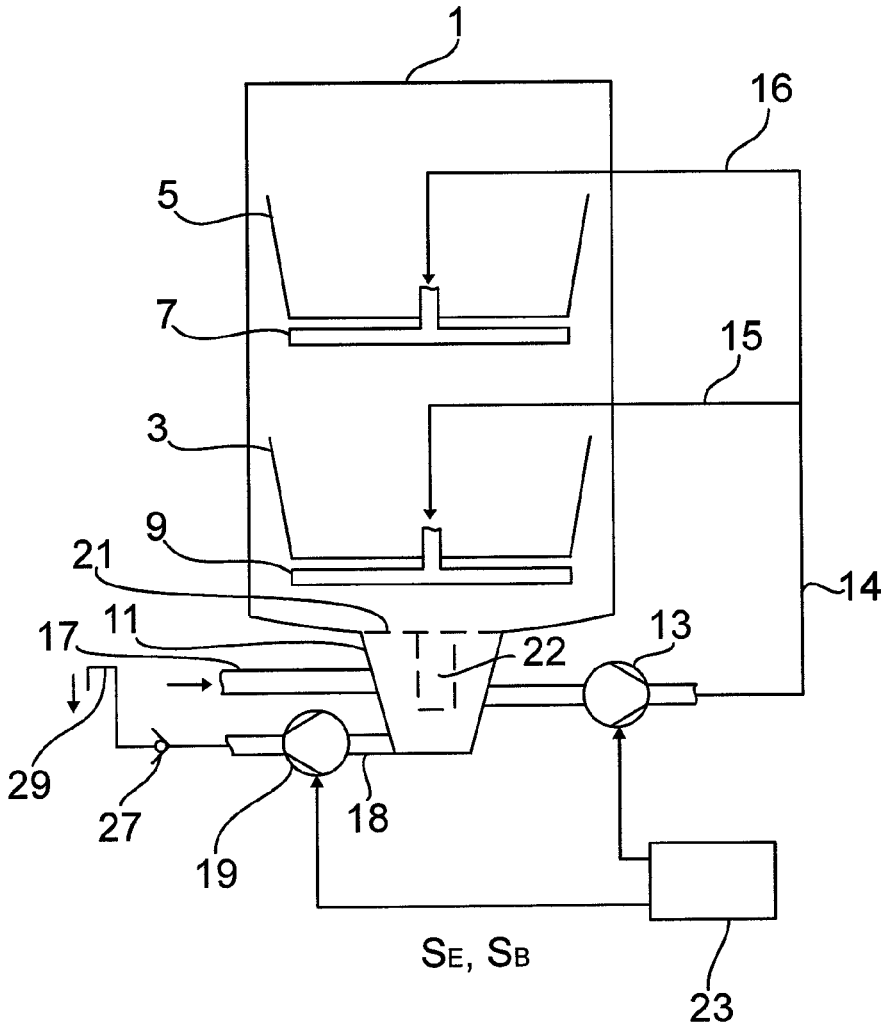
FIG. 1 shows a dishwasher in a schematic block diagram.

In FIG. 1 a dishwasher comprising a rinse container 1 is shown in an approximately schematic manner as an exemplary embodiment for a water-conducting household appliance, in which items to be cleaned, not shown, may be arranged in crockery baskets 3, 5. In the rinse container 1 shown, by way of example two spray arms 7, 9 provided in different spray planes are arranged as spray devices, and by which the items to be cleaned are subjected to rinsing fluid. In the bottom of the rinse container, a sump 11 with an associated circulating pump 13 is provided, which is connected in terms of flow technology via fluid pipes 14, 15, 16 to the spray arms 7, 9.

The sump 11 is, moreover, connected to a fresh water supply pipe 17 coupled to the water supply system as well as a discharge pipe 18, in which a discharge pump 19 for pumping out soiled rinsing fluid from the rinse container 1 is arranged. According to FIG. 1, a non-return valve 27 is arranged downstream of the discharge pump 19. Downstream of the non-return valve 27 follows a siphon portion 29 in the waste water pipe with vertical pipe portions opposing one another, so that a fluid column of predetermined height in the blocking direction creates a fluid pressure against the non-return valve 27.

In the sump 11, a filter system is provided for cleaning the rinsing fluid circulating in the hydraulic circuit. The filter system has a planar, funnel-shaped fine filter 21 which is located on the upper side of the sump 11 and a hollow cylindrical pot-shaped coarse filter 22 inserted centrally in the sump 11.

During a rinsing cycle of the dishwasher, the operation of the pumps 13, 19 and further device components, not shown here, are controlled by the control device 23. A rinsing cycle may comprise partial program steps with and/or without the use of fluid, namely pre-rinsing, cleaning, intermediate rinsing, clean rinsing and drying.

A change of rinsing fluid takes place between two successive partial program steps with the use of fluid, namely between the pre-rinsing and the cleaning steps. When the rinsing fluid is changed, the soiled rinsing fluid which is no longer required is discharged out of the rinse container 1 into the waste water disposal system, by operating the discharge pump 19. Moreover, fresh water is introduced via the fresh water supply pipe into the sump 11.

Figure 2:
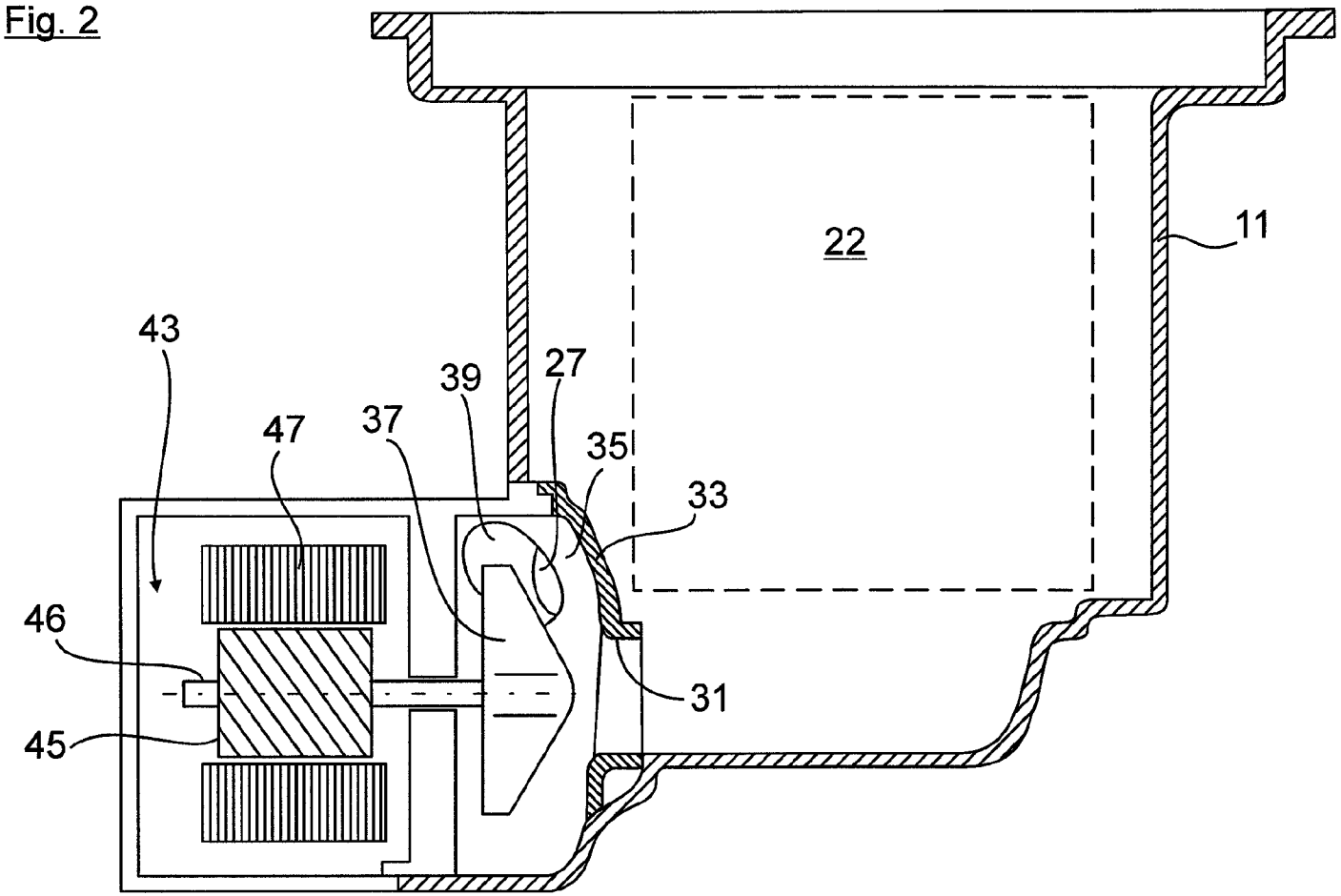
FIG. 2 shows in an enlarged sectional view the sump of the dishwasher with an associated discharge pump.

In FIG. 2, the sump 11 is shown with the associated discharge pump 19 in an enlarged sectional view. Inside the sump 11, the hollow cylindrical coarse filter 22 is indicated in dotted lines. On the floor side, the sump 11 is connected to the discharge pump 19 via a suction pipe 31. The suction pipe 31 is formed in a pump cover 33 of the discharge pump 19, which defines a pump chamber 35 on the front side. The discharge pump 19 has a pump impeller 37 which is rotatably mounted in the pump chamber 35. On a radial, outer side located behind the drawing plane, the pump chamber 35 opens into a delivery end 39 on the outlet side. Inside the delivery end 39, the non-return valve 27 configured as non-return flap may be seen, which during the pumping operation prevents a return flow through the delivery end 39 into the pump chamber 35.

The discharge pump 19 is, by way of example, driven by a three-phase brushless DC motor 43 with electronic commutation. The DC motor 43, indicated approximately in FIGS. 2 to 4, has a permanent magnet rotor 45, which is fastened to a rotor shaft 46, which in turn carries the pump impeller 37. The permanent magnet rotor 45 is surrounded by stator packets 47 arranged fixedly in terms of rotation, which during operation of the pump with corresponding activation by the control device 23 produce a rotating magnetic field which drives the permanent magnet rotor 45.

Figure 3:
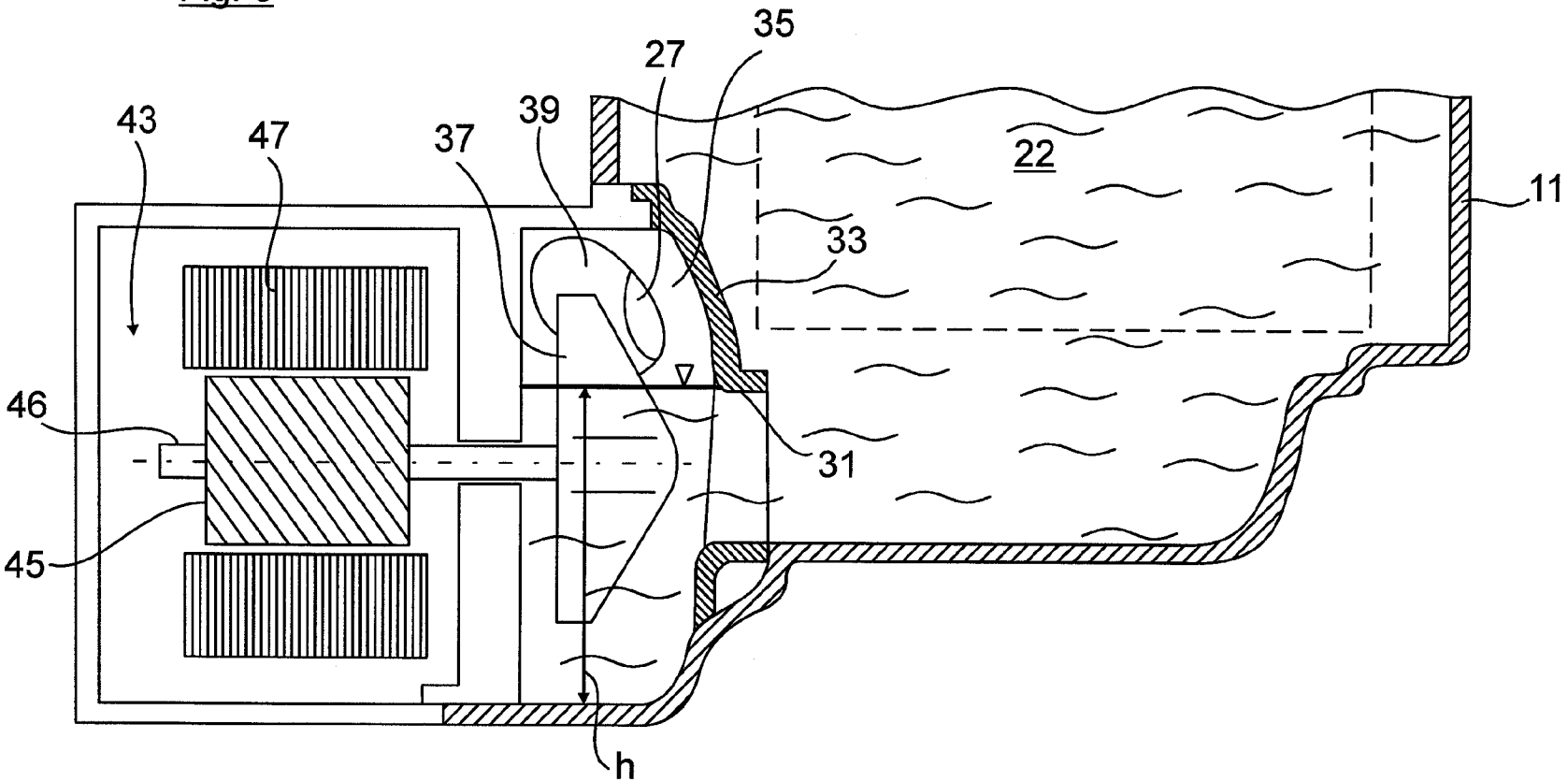
FIGS. 3 and 4 show in each case enlarged views of the sectional view shown in FIG. 2 with the pump impeller at a standstill as well as when the pump impeller performs a intermittent movement.

In FIG. 3 the discharge pump 19 is shown out of operation, so that the pump impeller 37 is at a standstill. In this state, in the pump chamber 35 a residual fluid column h is created, above which a gas bubble remains. According to FIG. 3, the gas bubble is captured in the upper apex of the pump chamber 35 and in the transition to the delivery end 39. Moreover, a pump impeller blade partially protrudes into the gas bubble.

During the rinsing cycle, the discharge pump 19 is activated for a change of fluid, which takes place after carrying out a partial program step, namely pre-rinsing, and before starting the subsequent partial program step, namely cleaning.

Figure 4:
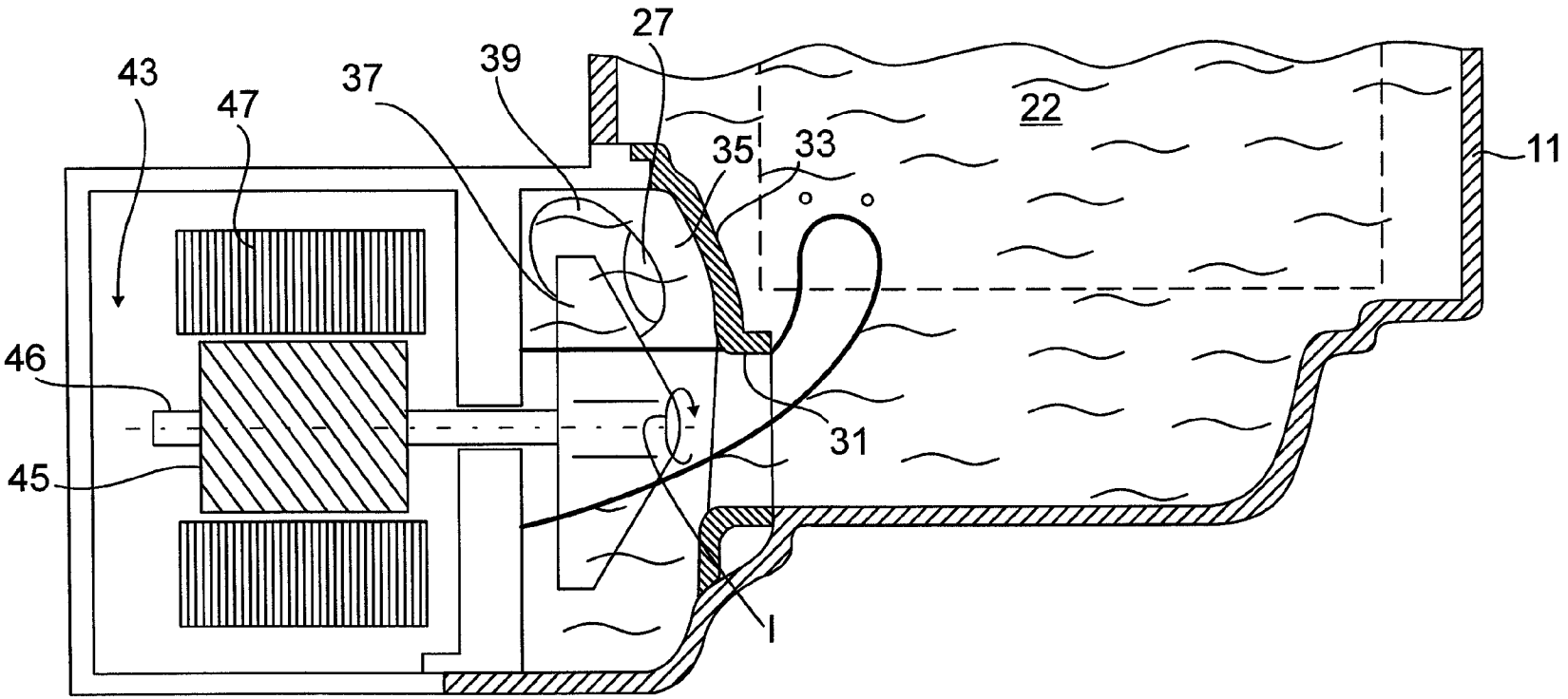

The gas bubble captured in the pump chamber 3 increases the time until the discharge pump 19 runs at a maximum delivery rate. Therefore, in a venting operating mode, the gas bubble is displaced from the pump chamber 35. The venting operating mode takes place immediately before the actual operation of the discharge pump 19. To this end, before the actual signal for the start of operation $S_B$, the discharge pump 19 is activated by a venting signal $S_E$, which starts the venting operating mode. In the venting operating mode, two phases of the three-phase DC motor 43 are switched to conduct current, whereby the pump impeller 37 rotates by 270° in an intermittent manner. The intermittent rotational movement 1 is illustrated in FIG. 4 by an arrow.

The venting operating mode in this case comprises, by way of example, three successive intermittent rotational movements 1 of the pump impeller 37, which in each case are only separated from one another by fractions of a second, namely 0.3 s. As a result of each of these intermittent rotational movements 1 a radial annular flow circulating around the rotational axis of the pump impeller 37 is created to a certain extent from the stationary residual fluid column h, as shown in FIG. 4. By the creation of this annular flow, the gas bubble is displaced in the direction of the rotational axis of the pump impeller 37. Even before a laminar flow pattern is produced in the annular flow, the 270° rotational movement of the pump impeller 37 is again abruptly interrupted. As a result, according to FIG. 4, the gas bubble displaced relative to the rotational axis, to a large extent is literally projected from the pump chamber 35 through the suction pipe 31 into the sump 11.

Only after the completion of the venting operating mode, is the DC motor 43 activated by the signal for the start of operation $S_B$. In order to distinguish it from the intermittent rotational movement 1 of the pump impeller 37 during the venting process, when the operation is subsequently started, the rotational speed of the pump impeller 37 is not increased abruptly but continuously until the maximum pumping quantity is reached.

LIST OF REFERENCE NUMERALS

1 Rinse container
3, 5 Crockery baskets
7, 9 Spray arms
11 Sump
13 Circulating pump
15, 16 Fluid pipes
17 Fresh water supply pipe
19 Discharge pump
21 Fine filter
22 Coarse filter
23 Control device
27 Non-return valve
29 Siphon portion
31 Suction pipe
33 Pump cover
35 Pump chamber
37 Pump impeller
39 Delivery end
43 DC motor
45 Permanent magnet rotor
46 Rotor shaft
47 Stator packets
h Residual fluid column
1 Intermittent rotational movement
$S_E$ Venting signal
$S_B$ Signal for the start of operation

The invention claimed is:

1. A water-conducting household device, comprising a pump having at least one normal operating mode in which fluid is pumped in a pumping direction, and a venting operating mode executable before the normal operating mode and provided to allow venting of the pump by pumping a gas bubble in opposition to the pumping direction during the normal operating mode at least partially out of a pump chamber of the pump to a fluid pump inlet of the pump, wherein the fluid pump inlet is a fluid passage that is parallel to an axis of rotation of the pump.

2. The water-conducting household appliance of claim 1, constructed in the form of a dishwasher.

3. The water-conducting household appliance of claim 1, wherein the pump is constructed to produce an annular flow in the pump during the venting operating mode for at least partially displacing the gas bubble.

4. The water-conducting household appliance of claim 1, wherein the pump rotates in a rotational direction which is the same during the normal operating mode and the venting operating mode.

5. The water-conducting household appliance of claim 1, wherein the pump is operable during the venting operating mode with a different rotational speed characteristic than during the normal operating mode.

6. The water-conducting household appliance of claim 5, wherein the rotational speed characteristic during the venting operating mode has a greater rotational speed fluctuation range than during the normal operating mode.

7. The water-conducting household appliance of claim 5, wherein the rotational speed characteristic during the venting operating mode has larger and/or greater alterations to a rotational speed per unit of time than during the normal operating mode.

8. The water-conducting household appliance of claim 1, wherein the pump is constructed to allow discontinuous operation during the venting operating mode.

9. The water-conducting household appliance of claim 1, wherein the pump has a lower delivery rate during the venting operating mode than during the normal operating mode of the pump.

10. The water-conducting household appliance of claim 1, wherein the pump is constructed as a discharge pump having a sump, said fluid pump inlet being connected to the sump.

11. The water-conducting household appliance of claim 1, wherein the pump has a pump impeller, said pump impeller executing at least one intermittent rotational movement at least occasionally during the venting operating mode.

12. The water-conducting household appliance of claim 11, wherein the pump impeller during the intermittent rotational movement rotates by a rotational angle which is less than 360°.

13. The water-conducting household appliance of claim 11, wherein the pump impeller during the intermittent rotational movement rotates by a rotational angle which is less than 240°.

14. The water-conducting household appliance of claim 11, wherein the pump impeller during the intermittent rotational movement rotates by a rotational angle which is 120°.

15. The water-conducting household appliance of claim 11, wherein during the venting operating mode the pump impeller performs a sequence of intermittent rotational movements.

16. The water-conducting household appliance of claim 15, wherein the intermittent rotational movements of the pump impeller are chronologically spaced apart from one another by a predetermined time period.

17. The water-conducting household appliance of claim 16, wherein the time period is substantially 0.1 s to 0.5 s.

18. The water-conducting household appliance of claim 16, wherein the time period is from 0.2 s to 0.4 s.

19. The water-conducting household appliance of claim 11, wherein during the venting operating mode the pump impeller performs a sequence of three to five intermittent rotational movements.

20. The water-conducting household appliance of claim 11, wherein the pump is constructed such that the pump impeller executes the intermittent rotational movement repeatedly at time intervals spaced apart from one another.

21. The water-conducting household appliance of claim 11, wherein the intermittent movement of the pump impeller extends over a time period substantially of 0.05 s to 0.5 s.

22. The water-conducting household appliance of claim 11, wherein the intermittent movement of the pump impeller extends over a time period from 0.1 s to 0.2 s.

23. The water-conducting household appliance of claim 1, wherein the pump has a non-return valve element on a pressure side, said non-return valve element being closed during the venting operating mode.

24. The water-conducting household appliance of claim 1, further comprising a DC motor for driving the pump.

25. The water-conducting household appliance of claim 24, wherein the DC motor is a brushless DC motor with electronic commutation.

26. The water-conducting household appliance of claim 24, wherein the pump has a pump impeller, said DC motor being a two-phase DC motor for producing an intermittent rotational movement of the pump impeller, wherein only one phase of the two-phase DC motor is switched to conduct current.

27. The water-conducting household appliance of claim 24, wherein the pump has a pump impeller, said DC motor being a three-phase DC motor for producing an intermittent rotational movement of the pump impeller, wherein only two phases are switched to conduct current.

28. The water-conducting household appliance of claim 1, wherein the pump chamber comprises a fluid inlet that the fluid enters while moving in the pumping direction and that the gas bubble exits during the venting operation.

29. The water-conducting household appliance of claim 1, wherein the pump does not include a ventilation opening in the pump chamber.

30. The water-conducting household appliance of claim 1, wherein the pump chamber comprises a fluid inlet and the venting operation mode is adapted to displace the gas bubble along the axis of rotation of the pump and through the fluid inlet.

31. A method for operating a water-conducting household appliance, comprising:

venting a pump of the water-conducting household appliance, before start-up of the pump, in a venting operating mode; and operating the pump, at least occasionally, in a normal operating mode in which fluid is pumped in a pumping direction, wherein during the venting operating mode a gas bubble is pumped in opposition to the pumping direction during the normal operating mode and at least partially out of a pump chamber of the pump to a fluid pump inlet of the pump, wherein the fluid pump inlet is a fluid passage that is parallel to an axis of rotation of the pump.

32. The method of claim 31 for operating a dishwasher.

33. The method of claim 31, wherein during the venting operating mode the gas bubble is at least partially displaced by an annular flow in the pump, which annular flow is produced by the pump.

34. The method of claim 31, wherein the pump is operated in a same rotational direction during the normal operating mode and the venting operating mode.

35. The method of claim 31, wherein the pump is operated during the venting operating mode with a different rotational speed characteristic than during the normal operating mode.

36. The method of claim 35, wherein the rotational speed characteristic during the venting operating mode has a greater rotational speed fluctuation range than during the normal operating mode.

37. The method of claim 35, wherein the rotational speed characteristic during the venting operating mode has larger and/or greater alterations to a rotational speed per unit of time than during the normal operating mode.

38. The method of claim 31, wherein the pump is operated discontinuously during the venting operating mode.

39. The method of claim 31, wherein the pump pumps a smaller quantity of fluid during the venting operating mode than during the normal operating mode of the pump.

40. The method of claim 31, wherein the pump is a discharge pump having a sump, further comprising connecting the fluid pump inlet to the sump.

41. The method of claim 31, further comprising operating a pump impeller of the pump to carry out at least one intermittent rotational movement at least occasionally during the venting operating mode.

42. The method of claim 41, wherein the pump impeller during the intermittent rotational movement rotates by a rotational angle which is less than 360°.

43. The method of claim 41, wherein the pump impeller during the intermittent rotational movement rotates by a rotational angle which is less than 240°.

44. The method of claim 41, wherein the pump impeller during the intermittent rotational movement rotates by a rotational angle which is 120°.

45. The method of claim 41, wherein during the venting operating mode the pump impeller performs a sequence of intermittent rotational movements.

46. The method of claim 45, wherein the intermittent rotational movements of the pump impeller are chronologically spaced apart from one another by a predetermined time period.

47. The method of claim 46, wherein the time period is substantially 0.1 s to 0.5 s.

48. The method of claim 46, wherein the time period is from 0.2 s to 0.4 s.

49. The method of claim 41, wherein during the venting operating mode the pump impeller performs a sequence of three to five intermittent rotational movements.

50. The method of claim 41, wherein the intermittent rotational movement of the pump impeller is repeated at time intervals spaced apart from one another.

51. The method of claim 41, wherein the intermittent rotational movement of the pump impeller extends over a time period substantially of 0.05 s to 0.5 s.

52. The method of claim 41, wherein the intermittent rotational movement of the pump impeller extends over a time period from 0.1 s to 0.2 s.

53. The method of claim 31, wherein during the venting operating mode a non-return valve element on a pressure side of the pump is kept closed.

54. The method of claim 31, further comprising driving the pump using a DC motor.

55. The method of claim 31, further comprising driving the pump using a brushless DC motor with electronic commutation.

56. The method of claim 55, wherein the DC motor is a two-phase DC motor, further comprising operating a pump impeller of the pump, and switching only one phase of the two-phase DC motor to conduct current for producing an intermittent rotational movement of the pump impeller.

57. The method of claim 55, wherein the DC motor is a three-phase DC motor, further comprising operating a pump impeller of the pump, and switching only two phases of the three-phase DC motor to conduct current for producing an intermittent rotational movement of the pump impeller.

58. A water-conducting household device, comprising:

a pump with a pump inlet and a pumping chamber;

a normal operating mode that draws fluid into the pump through the pump inlet in a pumping direction and into the pumping chamber; and a venting operating mode that at least partially expels a gas bubble from the pumping chamber in a direction opposite to the pumping direction and at least partially out of the pump inlet, wherein the pump inlet is a fluid passage that is parallel to an axis of rotation of the pump.

* * * * *